US007304569B2

(12) United States Patent
Marcichow

(10) Patent No.: US 7,304,569 B2
(45) Date of Patent: Dec. 4, 2007

(54) NETWORKING OF DISCRETE PLUMBING DEVICES

(75) Inventor: Martin E. Marcichow, Hoffman Estates, IL (US)

(73) Assignee: Sloan Valve Company, Franklin Park, IL (US)

( * ) Notice: Subject to any disclaimer, the term of this patent is extended or adjusted under 35 U.S.C. 154(b) by 248 days.

(21) Appl. No.: 11/196,215

(22) Filed: Aug. 3, 2005

(65) Prior Publication Data

US 2007/0030145 A1 Feb. 8, 2007

(51) Int. Cl.
*G08B 1/08* (2006.01)

(52) U.S. Cl. ..... 340/539.1; 340/506; 340/825.36; 340/825.49; 340/3.1

(58) Field of Classification Search ..... 340/506, 340/539.1, 825.36, 825.49, 3.1
See application file for complete search history.

(56) References Cited

U.S. PATENT DOCUMENTS 4,914,758 A 4/1990 Shaw
4,999,607 A * 3/1991 Evans ..... 340/533
5,202,666 A 4/1993 Knippscheer
5,829,467 A 11/1998 Spicher
5,845,844 A 12/1998 Zosimodis
6,206,340 B1 3/2001 Paese et al.
6,250,601 B1 6/2001 Kolar et al.
6,286,764 B1 9/2001 Garvey et al.
6,388,609 B2 5/2002 Paese et al.
6,568,655 B2 5/2003 Paese et al.
6,691,338 B2 2/2004 Zieger
6,717,513 B1 * 4/2004 Sandelman et al. ..... 340/506
6,724,873 B2 4/2004 Senna Da Silva
6,728,517 B2 4/2004 Sugar et al.
6,749,122 B1 6/2004 Koenck et al.
6,906,617 B1 * 6/2005 Van der Meulen ..... 340/538

* cited by examiner

*Primary Examiner*—Daryl C Pope
(74) *Attorney, Agent, or Firm*—Cook, Alex, McFarron, Manzo, Cummings & Mehler, Ltd.

(57) ABSTRACT

A network of wirelessly connected sanitary appliances, their associated triggering devices and a remotely located network node is disclosed. The remotely located network node permits the monitoring and gathering of information concerning the appliances and their associated triggering devices. The network node can be connected to a LAN and/or the internet allowing the node to communicate with responsible parties. In addition, a control board having a central processing unit is wirelessly connected as an intermediary between the appliances and triggering devices and the network node. Communication between the appliances and their triggering devices uses low frequency RF signals. Communication to the remotely located network node uses high frequency RF signals.

41 Claims, 2 Drawing Sheets

NETWORKING OF DISCRETE PLUMBING DEVICES

BACKGROUND OF THE INVENTION

The present invention relates to a network for the operation and remote monitoring of one or more wirelessly connected hygiene or sanitary appliances. More particularly, radio frequency (RF) transmitters and receivers replace hard wire connections between a triggering device, an appliance and a network node. Even more particularly, short range wireless communication between the triggering device and appliance utilizes low frequency radio signals while long range wireless communication to the network node utilizes high frequency RF.

Hygiene and sanitary appliances normally found in a public washroom typically include a urinal with a flush valve, a toilet with a flush valve, a sanitizer, a faucet, a showerhead, a soap dispenser, a paper towel dispenser, a hand dryer, a room deodorizer, among others. Such appliances may be operated by an individual through a triggering device such as an infra-red (IR) sensor or a manual switch which is located near or at the appliance and hard-wired to the appliances' electric operator.

There are environments in which it is not possible or desirable to have a hard-wired connection between the triggering device, which causes operation of the appliance, and the appliance itself. For example, in a toilet the electric operator for its flush valve may be behind a wall or partition and it is not practical to have the triggering device hard-wired to the flush valve. Similarly, there may be instances in which the flush valve for a urinal is behind a wall and it is not cost effective to have a hard-wire connection between the triggering device of the flush valve and the flush valve itself.

Further, in some washroom environments it may be desirable to have a control board which controls and preferably monitors the use and operation of all of the sanitary appliances within a certain area. This area could be a washroom or several washrooms located within a short range. Control boards are especially useful in washrooms in large institutions, especially buildings with washrooms open to the public. The control board would again require hard wire connections to each appliance and triggering device. The use of hard-wire connections may be difficult, costly and complicated especially considering the number of appliances and distances between the appliances and control board. In addition, in such an environment the wiring may subject to vandalism, corrosion and malfunction. Replacement of the hard-wire connection with a radio link has many advantages, including cost, security, reliability and ease of maintenance.

Hard-wired connections increase the difficulty and expense of establishing and maintaining local networks of triggering devices, appliances and control boards and prevent their widespread use. In addition, the difficulty and expense of hard-wired connections is only exacerbated by adding a network node for the global control, monitoring and information gathering of many localized networks consisting of control boards, triggering devices, and appliances throughout a building or institution.

U.S. patent application Ser. No. 09/704,224, which is incorporated by reference herein and made a part hereof, discloses a system of remote operation of hygiene or sanitary appliances through RF links thereby eliminating the hard-wire connections between a triggering device, appliance and control board, if used.

In addition to creating a wirelessly connected local network of a triggering device, appliance and control board if used, it would be desirable to wirelessly connect a network node to the local network to monitor and/or gather information and even communicate the information to responsible parties. It would also be desirable to minimize the complexity of the local network by having the network node perform the functions of the control board in addition to its monitoring and information gathering functions. Furthermore, it would be desirable to wirelessly connect more than one local network to the network node to create a larger global network that can be monitored at one location remote from the local networks and even remote from the network node.

SUMMARY OF THE INVENTION

In more and more washrooms, especially public washrooms, the manually-operated sanitary appliances such as flush valves associated with urinals and toilets, faucets, showers, sanitizer dispensers and soap dispensers are being replaced with electrically-operated valves. A triggering device such as an IR sensor or pushbutton switch has traditionally been hard-wired to the associated appliance. Other sanitary appliances such as hand dryers, and paper dispensers are either being replaced with electrically-operated appliances and/or are being used with IR sensors. All of these electrically-operated appliances have required a hard-wired connection between the. appliance and their associated triggering devices. Using a toilet as an example of such a sanitary appliance, there is a hard-wired connection between the electric operator of the flush valve and the triggering device whether it is a sensor, such as an IR sensor, or a pushbutton in which the user of the device manually operates the pushbutton to ensure its operation.

Similarly, there have been hard-wired connections to operate other appliances such as shower heads, soap dispensers, paper towel dispensers, sanitizers and room deodorizers. The present invention is applicable to any personal hygiene and/or sanitary appliance and triggering device. Specifically, the present invention replaces a hard-wired connection between a triggering device and its associated appliance with an RF communication link. In addition, since the triggering device and appliance are connected wirelessly using RF technology, the invention includes the addition of a remote wirelessly connected network node that controls, monitors and/or gathers information on the appliances. More specifically, the triggering device communicates to the appliance using low frequency radio signals since the distances are short while the communication to the network node is done with high frequency radio signals to accommodate larger distances.

In another embodiment of the present invention, a control board is interfaced between one or more triggering device(s) and its/their associated appliance(s) using high frequency radio signals to control the operation of the appliance(s) according to programmed instructions contained in a microprocessor and communicates information with the network node using high frequency radio signals.

In yet another embodiment of the present invention, the network node includes a control board so that upon receipt of high frequency radio signals from a triggering device, the network node sends a high frequency radio signal to cause the appliance associated to the triggering device to operate according to programmed instructions. In this manner the network node controls the appliances and also gathers information.

DETAILED DESCRIPTION OF THE INVENTION

Figure 1:
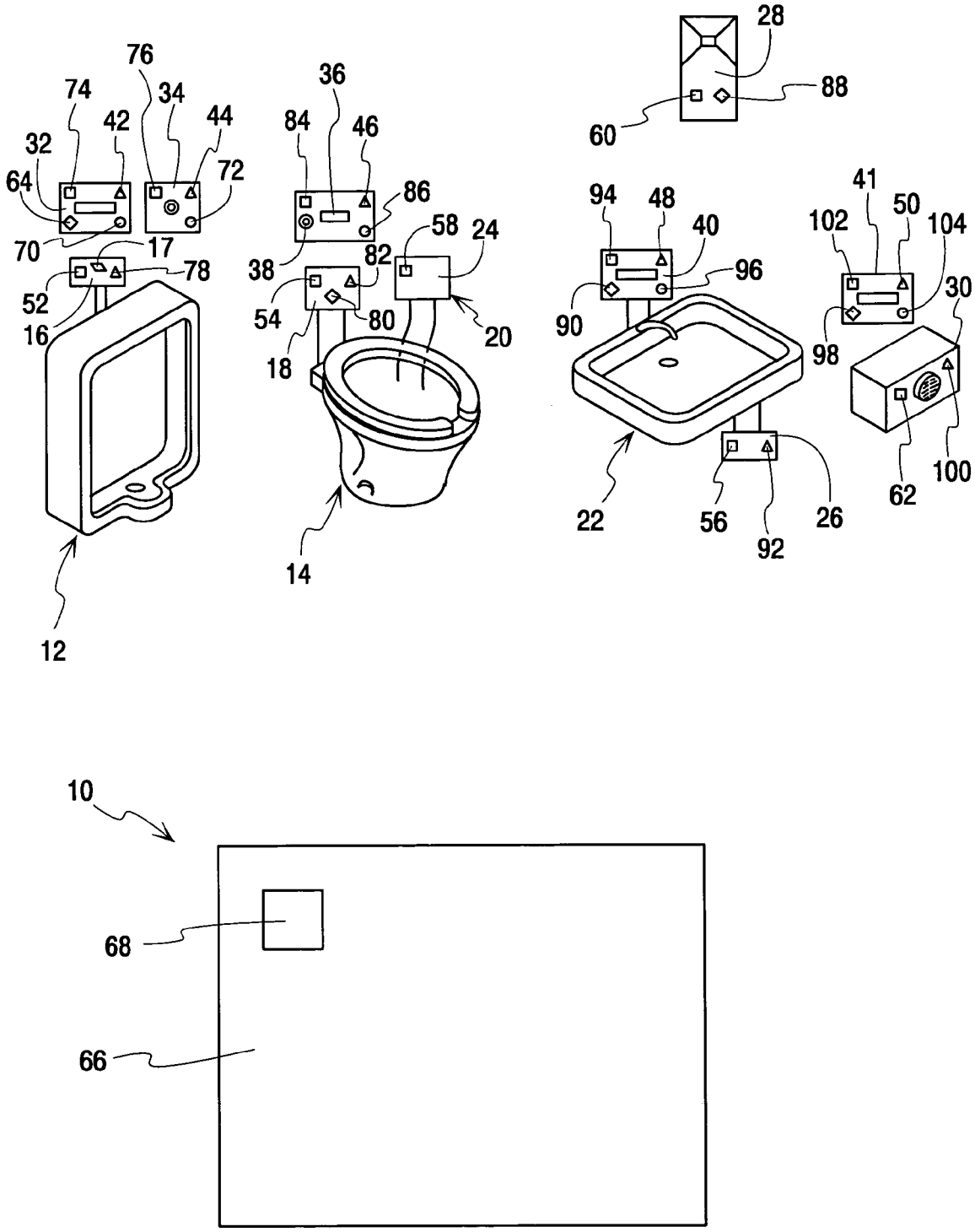
FIG. 1 shows a network of appliances wirelessly connected to their associated triggering devices and to a network node.

FIG. 1 shows a wirelessly connected network 10 including several appliances in a washroom setting utilizing IR sensor and pushbutton triggering devices and a remotely located network node. Either an infrared sensor or a pushbutton triggering device may be used with any appliance and there are also instances in which both triggering devices may be utilized with such an appliance in two separate fixtures or both types of triggering devices in a single fixture.

Urinal 12 and toilet 14 each have an attached flush valve 16 and 18, respectively. Sanitizer 20 and faucet 22 each have a valve 24 and 26, respectively. Also shown is room deodorizer 28 and hand dryer 30. All of the valves may be either battery operated or connected to a local power source. The flush valves in particular may be of the type shown in U.S. Pat. Nos. 5,169,118 and 5,244,179, both owned by the assignee of the present application, Sloan Valve Company of Franklin Park, Ill. The disclosures of the '118 and '179 patents are incorporated herein by reference. Each of the valves includes an electric operator, such as a solenoid, powered either by battery or by connection to local power. Upon actuation the electric operator will cause the valve to pass a measured amount of fluid. In the embodiment shown in FIG. 1, flush valves 16 and 18 include the described electric actuator and battery power if desired. These are preferably contained within the valve itself.

A triggering device is associated with every appliance. Some triggering devices can control more than one appliance, as will be described in more detail below.

Associated with the flush valve 16 is an infrared (IR) sensor 32 which is shown as a part of the flush valve apparatus in the '118 and '179 patents, but is disclosed herein at a location separate and apart from the flush valve 16. Preferably a second trigger device, in this case a pushbutton switch 34, is also associated with flush valve 16. Associated with toilet 14 is IR sensor 36 and pushbutton switch 38. In contrast to the IR sensor 32 and pushbutton switch 34, which are separate units, IR sensor 36 and pushbutton switch 38 are included in a single fixture. Faucet 22 and hand dryer 30 each only have an IR sensor 40 and 41 respectively.

Each triggering device has a radio frequency (RF) transmitter associated with it. Specifically, RF transmitters 42 and 44 are electrically connected and controlled by IR sensor 32 and pushbutton switch 34, respectively. RF transmitter 46 is electrically connected to both IR sensor 36 and pushbutton switch 38 and is controlled by either the sensor or the pushbutton. RF transmitters 48 and 50 are electrically connected and controlled by IR sensors 40 and 41 respectively.

In addition, an RF receiver is associated with each appliance. Specifically, the flush valves 16 and 18 and valve 26 for the faucet 22 have RF receivers 52, 54 and 56 electrically connected to the electric operators (not shown) of each valve. Sanitizer 20, room deodorizer 28 and hand dryer 30 also have RF receivers 58, 60 and 62 electrically connected to each appliance. The RF transmitter and receivers can be battery operated or connected to local power.

Since these RF transmitters and receivers will be communicating locally or within a washroom area they typically operate in low frequency ranges and require small amounts of power. However, since some washrooms may be quite large, RF communication with certain appliances such as a remotely located room deodorizer would be beyond the range of low frequency radio transmitters. In these instances, RF transmitters must be able to operate at high frequencies.

For short range communication, low frequency, low power RF transmitters are preferred. These RF transmitters and receivers preferably operate in the low frequency range at about 133 KHz and the normal maximum power that would be used at the transmitter is about 10-20 milliwatts. These types of low frequency, low power transmitters allow short range local communication of approximately 4-5 ft.

In addition, the RF transmitters of the triggering devices and/or appliances include the ability to operate in high frequency ranges which requires more power usage. Alternatively, a second high frequency RF transmitter and/or receiver is included with each triggering device and/or appliance. The high frequency RF transmitters and receivers are used to communicate across longer distances. Preferred high frequency radio transmitters and receivers have a range of about 100-200 feet and operate in the high frequency range, preferably at 100-1000 MHz. Both the low and high frequency radio transmitters and receivers can be battery operated or connected to local power.

As shown in FIG. 1 a separate high frequency RF transmitter 64 is electrically connected to and controlled by IR sensor 32 to send a signal to a network node 66 that is remotely located outside the range of low frequency transmitters but within the operational range of the transmitter 64.

Network node 66 has a high frequency radio receiver 68 to receive high frequency signal sent by the triggering devices and/or appliances. Network node 66 monitors and gathers operational information from all the appliances, including when and how often the appliance has been utilized. The network node may optionally include a data storage device such as a flash memory chip. The information that is gathered by the network node can be used to calculate the amount of any consumables used or when maintenance is required. In a large institution, there may some washrooms that receive much more traffic than others so the usage information can prevent expending scarce maintenance resources on underutilized areas.

In addition to gathering information the network node can optionally be used as a master control to control the operation of the appliances upon requests from the triggering devices. In other words, the network node can perform the function of the control board which will be explained in greater detail below.

The network node 66 can be connected to a local area network (LAN) and/or the internet. The network node can be programmed to send information via the LAN to responsible parties on a regular basis. The network node can further be programmed to predict what consumables or maintenance issue may arise and to notify the appropriate personnel accordingly. In addition, responsible parties can access the information at any time through the internet.

Preferably there is a way to provide information to a user of an appliance that the RF signal has been sent and received. Accordingly, IR sensor 32 and pushbutton switch 34 each include an indicator, in this case a light emitting diode (LED) 70 and 72 respectively. LEDs 70 and 72 are electrically connected to and controlled by low frequency receivers 74 and 76, respectively. To complete the communication link, flush valve 16 includes a low frequency transmitter 78. In lieu of an LED, a speaker providing an audible notification can be used. Or both the LED and speaker could be used.

In operation, when the sensor 32 detects an individual at the urinal 12, the sensor is programmed to operate the flush valve upon the timing out of an on-delay period which begins when the sensor no longer detects an individual. This is the same for the sensor 36 of toilet 18. In FIG. 1, sensor 32 causes the transmitter 42 to send a low frequency radio signal to the receiver 52 of flush valve 16 and this signal will have a unique identifier peculiar to the particular flush valve or appliance which is to be operated. In addition, high frequency transmitter 78 will send a high frequency RF signal to receiver 68 of the network node 66 and this signal will have a unique identifier peculiar to the particular flush valve or appliance which is to be operated. Since the flush valve or appliance in this instance is the same, the high and low frequency signal can have the same unique identifier unless the actual frequency is used as an identifier. Unique identifiers are necessary to distinguish the transmitters and receivers since the signal is sent over the air and is received by all the receivers within the operational distance and frequency range of the receiver.

The identifier can be an address such as a numeric or alphanumeric address which is carried by the signal. Alternatively, the signal itself can have a unique frequency which acts as an identifier. As an example, the low frequency transmitter 42 and high frequency transmitter 64 each associated with the sensor 32 may have an address of 100 and this may be in either digital or analog form, with the number 100 being purely for illustrative purposes. The low frequency receiver 52 at the flush valve 16 is set (either manually or automatically) to receive a specific address such as 100 or a specific frequency whereas the high frequency receiver 68 is set to receive as many specific addresses as there are appliance transmitters. Upon receipt of the address, the flush valve electric operator will begin its operating cycle. Simultaneously, the transmitter 78 associated with flush valve 16 will transmit a message having an address in this instance represented by the number 105. The receiver 74 at the sensor 32 is set to receive only the signal having the unique address 105 and when this message, characterized as an acknowledgment message, is received it will cause the LED 70 to be illuminated. Thus, the sensor operates to send an intent message to the flush valve by a low frequency radio signal and an informational message to the network node by a high frequency radio signal. The flush valve receiver is set to receive only that intent message, whereas the network node receiver is set to receive as many informational messages as there are appliance transmitters. When such an intent message is received, the flush valve receiver causes the flush valve to operate. The flush valve receiver also sends an acknowledgment message back to the sensor, indicating that the instruction has been received. The receiver at the sensor receives the acknowledgement message and causes the indicator to operate.

The pushbutton 34 operates the same as the sensor 32 and the addresses may be the same for both the receivers 74 and 76 and both transmitters 42 and 44. Thus, the pushbutton 34 may be used as an alternate to the sensor. It is particularly useful as an override device or if it was desired to operate the flush valve for maintenance purposes.

Since vandalism can be an issue in public washrooms, the appliances can include a microprocessor connected to the. RF receiver and transmitter to operate the appliance according to programmed instructions. In essence, the microprocessor will perform the function of a control board as described below but only for its associated appliance.

Using the urinal 12 as an example, the sensor 32 upon its activation causes low frequency transmitter 42 to send a low frequency radio signal with a unique address and high frequency transmitter 64 to send a high frequency radio signal with a unique address. The receiver 52 which is set to respond only to signals with the address unique to the appliance relays the signal to the microprocessor 17. Microprocessor 17 causes the low frequency transmitter to send a low frequency radio signal having a unique address which low frequency receiver 74 is set to respond to by causing the activation of LED 70. The microprocessor then determines according to its programming whether the urinal flush valve 16 should be operated. With appropriate programming the microprocessor can prevent repeated requests to operate from either the push button 34 or IR sensor 32, which could be indicative of vandalism.

Instead of or in addition to the high frequency transmitter 64 incorporated in the sensor 32, the urinal flush valve may include a high frequency transmitter which is controlled by the microprocessor 17 to send informational signals on the operation of the urinal flush valve 16 to the network node 66. An alternate to providing a high frequency transmitter in the urinal flush valve 16 is to program the microprocessor 17 to send information on when the valve has actually been caused to operate to the sensor 32 via low frequency RF. The sensor can then relay the information to the network node 66. A further alternate is to send intent signals from the sensor 32 to both the valve 16 and the network node 66. The network node can be programmed to "know" how the microprocessor 17 will respond to the intent signals. This way the network node 66 can determine when the urinal flush valve has been operated by using the information signals sent by high frequency transmitter 64 whenever the IR sensor 32 is activated.

The operation of toilet 14 will now be explained. Sensor 36 detects an individual at the toilet 14 and is programmed to operate the flush valve a predetermined time after the sensor no longer detects an individual. As shown in FIG. 1, the transmitter 46 associated with sensor 36 and pushbutton 38 will send a low frequency radio signal to the receiver 54 of flush valve 18 and this signal will have a unique identifier peculiar to the toilet. To follow the same number sequence as above and for illustrative purposes only, the transmitter 46 will have an address of 110. Upon receipt of the signal having the 110 address, the receiver 54 will cause the flush valve electric operator to begin its operating cycle and will also cause the low frequency transmitter 82 to send an acknowledgement signal to the low frequency receiver 84. The acknowledgement signal will have a unique identifier to the toilet transmitter 82 which for illustrative purposes is 115 and the low frequency receiver 84 is set to receive only the unique address 115. Upon receipt of this acknowledge signal, receiver 84 causes the indicator 86 to operate.

Although the triggering device can include a high frequency transmitter to communicate with the network node as shown with respect to the urinal, an alternative arrangement is shown for the toilet 14. In this arrangement, the electric operator of flush valve 18 in turn causes the high frequency transmitter 80 to which it is electrically connected to send a high frequency RF signal to network receiver 68. This high frequency signal will have a unique identifier peculiar to the toilet. Since the high frequency transmitter is associated with the toilet the unique identifier can also be 110, the same as the low frequency transmitter 46. This is possible because the low frequency receiver 54 is not designed to receive signals having frequencies in the high frequency range, and thus the flush valve operator will not be activated.

The low frequency receiver 58 of sanitizer 24 is also set to receive only the signals having the unique identifier of low frequency transmitter 46. Therefore, upon receipt of a signal having the address 110, the low frequency receiver 58 will cause the sanitizer to dispense sanitizing solution into the toilet. The low frequency receiver 58 can preferably be connected to a timing circuit to control the dispensing of solution during the flush cycle to acheive the highest degree of sanitation at the least cost. The sanitizer can include a high frequency transmitter to send an informational message to the network node 66. But this is optional because the informational message from the flush valve will already tell the network node that a flush cycle has occurred. The network node can be programmed to determine the amount of sanitizing solution consumed by a simple calculation based on the number of flush cycles. This is true whether the sanitizer operates with every flush or every other flush or some other rate.

Room deodorizer 28 has a high frequency receiver 60 since it is remotely located in network 10. The high frequency receiver 60 of room deodorizer 28 can be set to receive signals having the unique identifier of one or more high frequency transmitters. In this particular instance, high frequency receiver 60 is set to receive signals having the unique address of both the high frequency transmitter 64 and 80. Once a signal having either of these addresses is received, room deodorizer dispenses a measured amount of deodorizer. Preferably, the room deodorizer includes a microprocessor connected to the receiver to cause the deodorizer 28 to operate under preprogrammed conditions. For example, the deodorizer can be programmed to dispense after every signal received from high frequency transmitter 80 and dispense after every fourth signal received from high frequency transmitter 64. Alternatively, the triggering device of the urinal and toilet can include a microprocessor to direct the high frequency transmitter to send a signal that is different from the information signal sent to the network node after a predetermined number of flushes.

This operational program of the deodorizer 28 can also be included in the network node to enable it to determine the amount of deodorizer consumed. However, in this instance, deodorizer 28 has a high frequency transmitter 88 which sends a high frequency signal having a unique identifier to provide information about the sanitizer to the network node 66 which is set to receive such an identifier.

Since the room deodorizer 28 in network 10 is remotely located the network node 66 could be incorporated in the room deodorizer 28 and vice versa. In other words, the network node would also be built into an appliance. This arrangement is particularly advantageous if the room deodorizer is to include a microprocessor since the function of the microprocessor could be performed by the network node. Indeed, the functions of the control board as will be explained below can be performed by the network node which would reduce the overall complexity of the network.

Moving on to the faucet 22 and using the same number sequence as representative of addresses, the faucet sensor 40 has a low frequency transmitter 48 which sends a signal having an address of 120 once an individual is detected. Low frequency receiver 56 is set to receive only such an address and causes the valve to open. The sensor 40 also causes high frequency transmitter 90 to send a high frequency radio signal having an address of 120 to network receiver 68 which set to receive such an address among others.

Low frequency receiver 56 also causes low frequency transmitter 92 to send a low frequency radio signal having a unique address of 125 to low frequency receiver 94 which is set to receive only such an address and cause LED 96 to illuminate.

Similarly, the hand dryer sensor 41 has a low frequency transmitter 50 which sends a signal having an address of 130 once an individual is detected. Low frequency receiver 62 is set to receive only such an address and causes the hand dryer to activate. The sensor 41 also causes high frequency transmitter 98 to send a high frequency RF signal having an address of 130 to network receiver 68 which set to receive such an address among others.

Low frequency receiver 62 also causes low frequency transmitter 100 to send a low frequency radio signal having a unique address of 135 to low frequency receiver 102 which is set to receive only such an address and cause LED 104 to illuminate.

Figure 2:
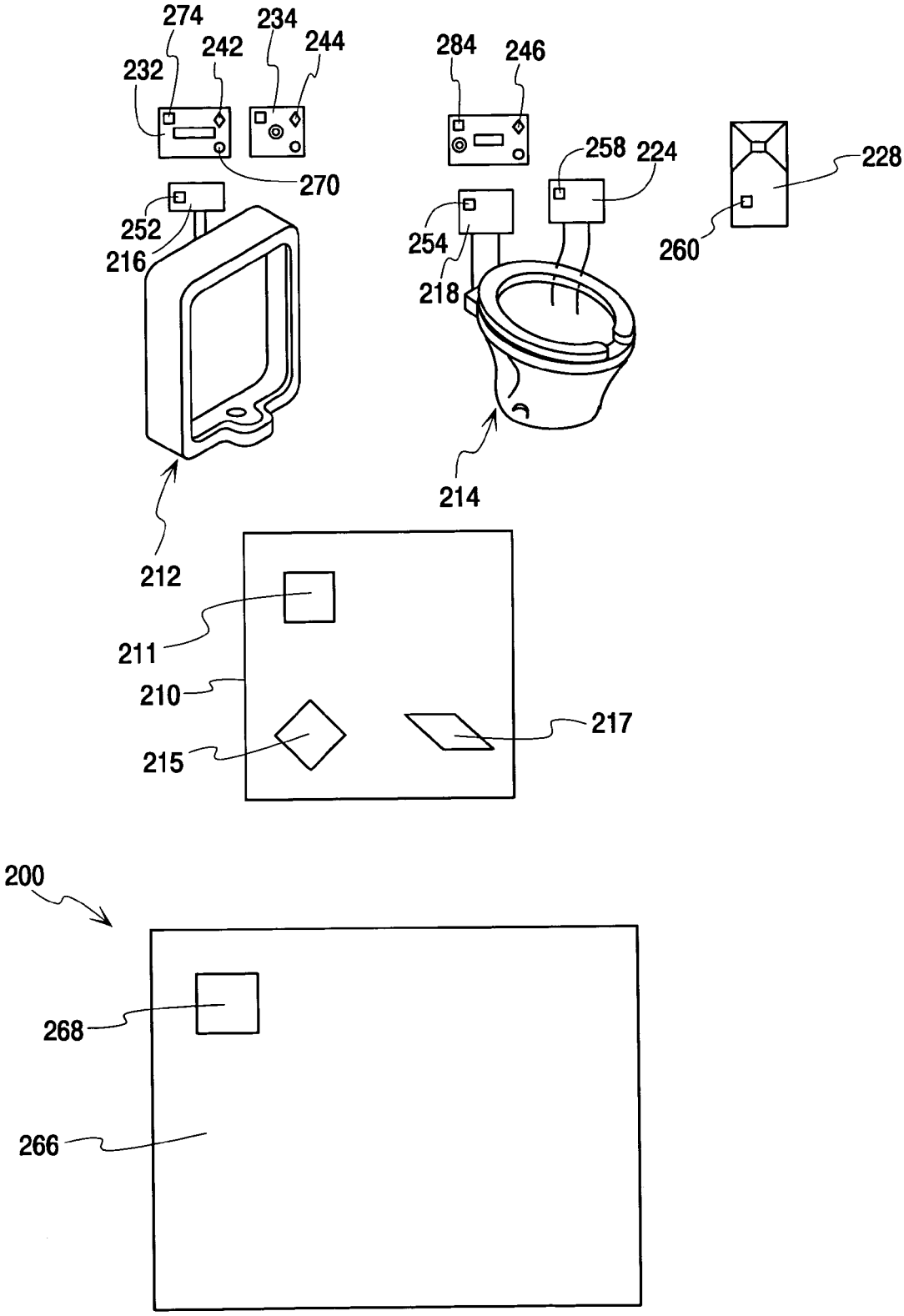
FIG. 2 shows a network of appliances wirelessly connected to their associated triggering devices and to a network node via high frequency radio signals to and from a control board.

FIG. 2 shows an alternate embodiment of the invention. Here network 200 includes a control board 210 placed in a washroom having one or more sanitary appliances. Alternatively, the control board can be placed intermediate one or more washrooms. The placement of the control board and/or the size of the washroom, will determine whether the wireless communication will take place over low or high radio frequency signals. There may be multiple flush valves, multiple faucets, multiple soap dispensers, multiple paper towel dispensers, multiple hand dryers, one or more shower heads and one or more room deodorizers in a single washroom environment or in two washrooms of an institution, e.g. "Mens" and "Womens" washrooms. FIG. 2 shows some of the appliances described in FIG. 1. Thus urinal 12 of FIG. 1 is now shown as urinal 212 and all the other appliances, triggering devices, transmitters and receivers follow the same numbering convention.

A control board is indicated at 210 and includes a high frequency radio receiver 211 and a high frequency radio transmitter 215. There is a microprocessor 217 within the control board 210 and the microprocessor may be one of the type shown in U.S. Pat. Nos. 6,038,519 and 5,966,753 owned by Sloan Valve Company of Franklin Park, Ill., assignee of the present application. The disclosure of these two patents is herein incorporated by reference. Specifically, such disclosure provides a hard-wired control system in which there are multiple inputs from multiple appliances and multiple outputs from the control board hard-wired to various appliances in such a way that a sensor associated to an appliance will provide an indication that there is an intent to operate the specific appliance and the microprocessor will determine, upon the programming stored therein, whether it is appropriate to operate that appliance and, if so, for what period of time.

Further, there may be programmed flushing of various flush valves, as shown in U.S. Pat. No. 5,235,706, also owned by Sloan Valve Company, and again the disclosure of which is incorporated by reference. The microprocessor is designed, as described in the above U.S. patents, to control the operation of multiple personal hygiene or sanitary appliances within a particular location and the communication with such appliances is over wiring which physically connects the sensor, the control board and the appliance.

The network 200 illustrated in FIG. 2 operates in a similar manner as network 10 except that all communications between the triggering devices and appliances are instead routed through the control board 210 using high frequency radio signals. It further employs the acknowledgment messaging of FIG. 1, and since the network is wirelessly connected using high frequency radio signals the control board can be placed outside the washroom setting. Furthermore, all high frequency information communication that is sent by either the appliance or triggering device as shown in FIG. 1 and described above is handled instead by the control board 210, although this is not required. More specifically, any one or all of the triggering devices of the appliances described in relation to FIG. 1 may all send high frequency radio signals via their respective high frequency transmitters which will be received by the high frequency radio receiver 211. Since each of those signals will have a different address, or appliance or triggering device designations, the high frequency receiver 211 is set to accept all such addresses and forward that information to the processor which in turn will perform its functions relative to operation of the particular appliance according to preprogrammed instructions. In addition, the control board sends a high frequency radio signal having a unique identifier to the network node to provide information on the operation of the appliance. If desired, the control board upon receipt of the signal from the triggering device requesting operation of the appliance can also send a high frequency radio signal having a unique identifier to the network node to inform it of the request from the triggering device. Alternatively, instead of the control board sending an informational message to the network node concerning the activation of the triggering device, the high frequency receiver can be set to accept signals from the triggering device directly, if it is within operational range, in addition to the informational message sent by the control board concerning the operation of the appliance.

As an example, when a high frequency radio signal is received by the receiver 211, the microprocessor 217 will determine which address has made a request. The microprocessor will then instruct the high frequency transmitter 215 to send a high frequency acknowledgment radio signal to that particular sensor or pushbutton, as the case may be. The acknowledgment signal contains the predetermined address and acknowledges receipt of the specific request to operate an appliance. This causes an associated indicator to operate. The microprocessor can also instruct the high frequency transmitter to send a high frequency informational signal to the network node on which address has made the request.

The microprocessor, by the programs stored therein, will then determine if the appliance should be operated and, if so, for how long and if an information message should be sent to the network node. For example, if there is a limit as to the number of flush valves that can be simultaneously operated, as disclosed in the '706 patent, then the microprocessor may delay operation of one or more flush valves. Further, in an institutional environment, in order to avoid problems with vandalism, it may be desired not to operate a urinal or a water closet every time there is a demand for its operation, but to do so in accordance with a predetermined program.

As shown in FIG. 2, when IR sensor 232 no longer detects an individual at the urinal 212, high frequency transmitter 242 sends a high frequency radio signal which is received by high frequency receiver 211 on control board 210. The control board 210 deciphers the unique identifier or address of the signal and recognizes the signal as a request to operate urinal flush valve 216. In addition, assuming the individual also depressed the pushbutton device 234, high frequency transmitter 244 also sends a high frequency radio signal which is received by the receiver 211. Again, the identifier or address of transmitter 242 may be the same as transmitter 244 in which case the control board will just recognize the signal as another request to operate the urinal flush valve. Preferably, the address of transmitter 242 is different from the address of transmitter 244 so that the control board 210 will recognize each transmitter individually.

Preferably, an acknowledgement system is also included in the network 200. Thus, upon receipt, the control board 210 will activate high frequency transmitter 215 to send an acknowledgement signal to IR high frequency receiver 274 which causes the LED 270 to illuminate. This high frequency acknowledgement signal has a unique address that only receiver 274 is set to respond to. Also, the control board is programmed to distinguish a valid request from invalid requests, e.g., multiple requests from vandals. When a valid request is found transmitter 215 sends another high frequency signal to receiver 252 which has a unique identifier that only receiver 252 is set to receive. The receiver 252 causes the flush valve 216 to operate.

In addition, after receiving the request signal from the urinal, high frequency transmitter 215 sends a high frequency signal which is received by high frequency receiver 268 of the network node 266. The high frequency signal also has a unique identifier so that the node can properly track which appliance sent the signal. In addition, the signal preferably includes information as to whether the appliance was actually operated. This information can be conveyed in several ways. One is by assigning a unique identifier for the appliance and for the action. In other words, the address for a urinal request that resulted in a flush would have an address different from an address for a urinal request that did not result in a flush. Regardless of the means, it is preferred that each request, whether acted on or not, be forwarded to the network node for a more complete operational picture of the network.

As described with respect to the network node of FIG. 1, network node 266 can be remotely located as far away as the range of the high frequency transmitter and receiver permits.

The toilet 214 operates in network 200 in a similar manner. A request with a unique address is sent from high frequency transmitter 246 which is received by receiver 211. Transmitter 215 sends a high frequency signal with a unique address which is received by receiver 284 causing the LED 286 to illuminate. If, according to its programming, the control board determines that the request is to be accommodated, transmitter 215 will send a high frequency signal having a unique address which only receiver 254 is set to receive. This causes the flush valve 218 to operate. In addition, transmitter 215 sends another high frequency signal having a unique address that only receiver 258 is set to receive. Once receiver 258 receives that signal it causes the sanitizer 224 to operate. Alternatively, receiver 258 of sanitizer 224 is set to respond to signals having the same address as the signal sent to receiver 254. Preferably, the address is unique to receiver 258 so that the sanitizer can be operated regardless of whether the toilet flush valve is operated. The programming of the control board can also delay the operation of the sanitizer 224 or even cause it to operate after a predetermined number of toilet flushes.

The control board can also operate the room deodorizer 228 according to its programming. For example, the control board 210 only sends a high frequency signal unique to the deodorizer receiver 260 after a certain number of urinal operation and/or toilet operations.

Communication between the control board 210 and the network node 266 can also occur in other ways. The control board may include a data storage device to store information regarding the operation of the various appliances and which after every predetermined interval communicates the information to the network node with high frequency transmitter 215. Preferably, the control board communicates the information without delay. As such, the control board can still include a data storage device which is used as a backup system in the event the high frequency communication between the control board and network node is interrupted or in the event the network node malfunctions. In addition, in institutions with several washrooms each having a control board and/or network node, information can be sent from control board to control board and then to the network node and/or from network node to network node until finally reaching final destination.

Alternatively, to reduce the complexity of the system, the functions of the control board can be incorporated into the network node. In this way, one fixture controls the operation of the appliances and gathers information at the same time. Not only does this reduce the number of physical components of the network but also eliminates the need to send separate information signals to the node since it is already receiving signals to operate the appliance. In other words, as shown in the network 10 of FIG. 1, the triggering device would send one signal to the network node instead of one signal which is acted upon by the appliance receiver and a separate informational signal to the network node. That one signal to the network node would suffice for the request to operate the appliance signal and the informational signal. The node then according to its programming would determine whether the appliance associated to the triggering device should be operated.

Although the present invention has been described by reference to certain preferred embodiments, it should be understood that the preferred embodiments are merely illustrative of the principles of the present invention. Therefore, modifications and/or changes may be made by those skilled in the art without departing from the true spirit and scope of the invention as defined by the appended claims.

I claim:

1. A sanitary appliance communication and monitoring network, comprising:

at least one sanitary appliance having a control circuit associated therewith;

a triggering device associated with the sanitary appliance and operable to generate an intent message unique to the triggering device;

a local radio frequency transmitter responsive to the triggering device to transmit the intent message;

a local radio frequency receiver capable of receiving the intent message and being electrically connected to the control circuit to selectively activate the sanitary appliance upon receipt of the intent message;

a global radio frequency transmitter electrically connected to one of the control circuit or the triggering device, the global radio frequency transmitter being operable to send an information message unique to said one of the control circuit or triggering device; and a network node spaced from the appliance and having a global radio frequency receiver capable of receiving said information message.

2. The network of claim 1 wherein the triggering device includes an infrared sensor.

3. The network of claim 1 wherein the triggering device includes a manually-activated switch.

4. The network of claim 1 wherein the triggering device includes an infrared sensor and a manually-activated switch.

5. The network of claim 1 wherein the appliance is an electrically-operated flush valve connected to a urinal.

6. The network of claim 1 wherein the appliance is an electrically-operated flush valve connected to a water closet.

7. The network of claim 1 wherein the appliance is an electrically-operated valve connected to a faucet.

8. The network of claim 1 wherein the appliance is a hand dryer.

9. The network of claim 1 wherein the intent message is transmitted via a low frequency radio signal.

10. The network of claim 9 wherein the information message is transmitted via a high frequency radio signal.

11. The network of claim 1 further comprising a sanitizer having a control circuit, the sanitizer being in fluid communication with said at least one sanitary appliance, a second local radio frequency receiver capable of receiving the intent message and being electrically connected to the sanitizer's control circuit to selectively activate the sanitizer upon receipt of the intent message.

12. The network of claim 1 further comprising a sanitizer having a control circuit, the sanitizer being in fluid communication with said at least one sanitary appliance, a second global radio frequency receiver capable of receiving the information message and being electrically connected to the sanitizer's control circuit to selectively activate the sanitizer upon receipt of the information message.

13. The network of claim 1 further comprising a second local radio frequency transmitter electrically connected to the local radio frequency receiver of the appliance, the second local radio transmitter sending an acknowledgement signal unique to the appliance when the radio frequency receiver of the appliance receives the intent message, and the triggering device further includes an indicator and a second local radio frequency receiver electrically connected to the indicator, the second local radio frequency receiver of the triggering device being operable to receive the acknowledgement signal and upon receipt thereof cause the indicator to operate.

14. The network of claim 13 wherein the indicator is a light emitting diode.

15. The network of claim 13 wherein the acknowledgement message is transmitted via a low frequency radio signal.

16. The network of claim 1 wherein the control circuit includes a microprocessor for controlling the operation of the appliance according to programmed instructions upon receipt of a unique intent message.

17. A sanitary appliance communication and monitoring network, comprising:

at least one sanitary appliance having a flush valve connected to it and a control circuit electrically connected to the flush valve for activating said valve;

a triggering device associated with the sanitary appliance and operable to generate an intent message unique to the triggering device;

a local radio frequency transmitter responsive to the triggering device to transmit the intent message;

a local radio frequency receiver capable of receiving the intent message and being electrically connected to the control circuit to selectively activate the flush valve upon receipt of the intent message;

a global radio frequency transmitter electrically connected to the control circuit, the global radio frequency transmitter being operable upon activation of the flush valve to send an information message unique to said control circuit; and a sanitizer spaced from the flush valve and in fluid communication with the sanitary appliance, the sanitizer having a global radio frequency receiver capable of receiving said information message and activating the sanitizer in response thereto.

18. The network of claim 17 wherein the triggering device includes an infrared sensor.

19. The network of claim 17 wherein the triggering device includes a manually activated switch.

20. The network of claim 17 wherein the triggering device includes an infrared sensor and a manually activated switch.

21. The network of claim 17 wherein the appliance is an electrically-operated flush valve connected to a urinal.

22. The network of claim 17 wherein the appliance is an electrically-operated flush valve connected to operate a water closet.

23. The network of claim 17 wherein the first radio frequency transmitter is a low frequency radio transmitter.

24. The network of claim 17 wherein the appliance includes a local radio frequency transmitter electrically connected to the control circuit of the appliance and programmed to send an acknowledgement signal unique to the appliance when the local radio frequency receiver of the appliance receives the intent message, and the triggering device includes an indicator and a local radio frequency receiver electrically connected to the indicator, the local radio frequency receiver of the triggering device being programmed to receive the acknowledgement signal and upon receipt thereof cause the indicator to operate.

25. The network of claim 24 wherein the indicator is a light emitting diode.

26. The network of claim 24 wherein the local radio frequency transmitter of the appliance is a low frequency radio transmitter.

27. The network of claim 17 wherein the control circuit of the sanitary appliance includes a microprocessor for controlling the operation of the appliance according to programmed instructions upon receipt of unique intent message.

28. The network of claim 17 wherein the global radio frequency transmitter of the appliance transmits signals in the high radio frequency range.

29. A sanitary appliance communication and monitoring network comprising:

at least one sanitary appliance, a radio frequency receiver electrically connected to each sanitary appliance to cause the associated sanitary appliance to operate upon receiving an operate message, the operate message being unique to the sanitary appliance;

a triggering device associated with each sanitary appliance for signaling an intent to operate the associated sanitary appliance, each triggering device having a radio frequency transmitter electrically connected thereto and operable thereby, each triggering device radio frequency transmitter being operable to send an intent message, the intent message being unique to the triggering device;

a network node remotely spaced from the at least one appliance and having a radio frequency receiver for receiving an information message; and a control board having a central processing unit electrically connected to a radio frequency receiver and a radio frequency transmitter, the control board's radio frequency receiver being capable of receiving the intent message and the control board's radio frequency transmitter being capable of sending the operate message;

wherein upon activation of the triggering device the triggering device radio frequency transmitter sends the intent message, and upon receipt of the intent message the central processing unit determines whether to send the operate message to cause operation of the sanitary appliance associated with the triggering device that sent the intent message.

30. The network of claim 29 further characterized in that the information message is unique to the sanitary appliance associated with the triggering device that sent the intent message, and the information message is sent upon the central processing unit determining that the operate message should be sent, the information message being sent by one of the control board's radio frequency transmitter or by a radio frequency transmitter electrically connected to each sanitary appliance's radio frequency receiver.

31. The network of claim 29 wherein the triggering device includes an infrared sensor.

32. The network of claim 29 wherein the triggering device includes a manually activated switch.

33. The network of claim 29 wherein the triggering device includes an infrared sensor and a manually activated switch.

34. The network of claim 29 wherein the sanitary appliance is an electrically-operated flush valve connected to operate a urinal.

35. The network of claim 29 wherein the information message includes data on the activation of the triggering device and on the operation of the associated sanitary appliance.

36. The network of claim 29 wherein the control board includes a high frequency radio transmitter and a low frequency radio transmitter, the low frequency radio transmitter sends the operate message and the high frequency radio transmitter sends the information message.

37. The network of claim 29 wherein the control board's radio transmitter sends the unique operate message and the unique informational message via a high frequency radio signal.

38. The network of claim 37 wherein each triggering device includes an indicator and a radio frequency receiver electrically connected to the indicator, the triggering device radio frequency receiver causes operation of the indicator upon receipt of an acknowledgement message unique to the triggering device, and upon activation of the triggering device the triggering device radio frequency transmitter sends the intent message and upon receipt of the intent message, the central processing unit causes the control board's radio frequency transmitter to send the acknowledgement message unique to the triggering device that sent the unique intent message and determines whether the control board's radio frequency transmitter sends the unique operate message to cause operation of the sanitary appliance associated to the triggering device that sent the intent message and the information message unique to the sanitary appliance associated to the triggering device that sent the intent message.

39. The network of claim 38 wherein the indicator is a light emitting diode.

40. A sanitary appliance communication and monitoring network comprising:

at least one sanitary appliance, a radio frequency receiver electrically connected to each sanitary appliance to cause the associated sanitary appliance to operate upon receiving an operate message, the operate message being unique to the sanitary appliance;

a triggering device associated with each sanitary appliance for signaling an intent to operate the associated sanitary appliance, each triggering device having a radio frequency transmitter electrically connected thereto and operable thereby, each triggering device radio frequency transmitter being able to send an intent message, the intent message being unique to the triggering device; and a network node remotely spaced from the at least one sanitary appliance and having a central processing unit electrically connected to a radio frequency receiver and a radio frequency transmitter;

wherein upon activation of the triggering device the triggering device radio frequency transmitter sends the intent message and upon receipt of the intent message by the radio frequency receiver of the network node, the central processing unit determines whether the radio frequency transmitter of the network node sends the unique operate message to cause operation of the sanitary appliance associated with the triggering device that sent the unique intent message.

41. The network of claim 40 wherein the network node records the unique intent message and the unique operation message.

* * * * *